US006609688B1

(12) United States Patent
Mazzella et al.

(10) Patent No.: US 6,609,688 B1
(45) Date of Patent: Aug. 26, 2003

(54) SUPPORT BLOCKS

(75) Inventors: Anthony J. Mazzella, Olmstead Falls, OH (US); John Ellsworth, Medina, OH (US); Brad Ayers, Fairview Park, OH (US)

(73) Assignee: Mazzella Wire Roped Sling, Cleveland, OH (US)

( * ) Notice: Subject to any disclaimer, the term of this patent is extended or adjusted under 35 U.S.C. 154(b) by 0 days.

(21) Appl. No.: 10/073,401

(22) Filed: Feb. 11, 2002

(51) Int. Cl.[7] ..... F16M 11/20

(52) U.S. Cl. ..... 248/188.8; 248/188.2; 248/678; 248/688

(58) Field of Search ..... 248/188.8, 188.2, 248/500, 678, 688; 72/352

(56) References Cited

U.S. PATENT DOCUMENTS 4,643,663 A * 2/1987 Bowles et al. ..... 425/406
4,703,911 A * 11/1987 Rammell ..... 248/188.9
5,110,082 A * 5/1992 Rowan, Jr. ..... 248/649
5,704,582 A * 1/1998 Golembiewski et al. . 248/188.2
5,746,638 A * 5/1998 Shiraishi ..... 446/131
6,024,626 A * 2/2000 Mendelsohn ..... 446/124

* cited by examiner

*Primary Examiner*—Anita King
(74) *Attorney, Agent, or Firm*—John M. Skeriotis; Brouse McDowell; Heather M. Barns

(57) ABSTRACT

An ergonomic die buffer comprises a load-bearing base having a central axis extending longitudinally through the midpoint of the load-bearing base. The load-bearing base also comprises a longitudinal axis that may be coaxial with the central axis of the load-bearing base or displaced therefrom. A neck portion is operatively connected to the base and a foot is connected to the neck portion. The neck comprises a central axis, such that the neck is connected to the base coaxially with the longitudinal axis. When the longitudinal axis is displaced from the central axis of the load-bearing base, there is greater contract between the topside surface area of the base and the associated die. The foot comprises at least one flat surface in order to provide greater surface contact between the topside of the base and an associated die. The die buffer may be secured to an associated die either by magnets or through a spring-loaded mechanism.

26 Claims, 7 Drawing Sheets

SUPPORT BLOCKS

BACKGROUND OF THE INVENTION

1. Field of Invention

This invention pertains to the art of methods and apparatuses for a die buffer, and more specifically to methods and apparatuses for a die buffer having a foot to provide for greater surface contact between a die and the die buffer.

2. Description of the Related Art

Dies are commonly used in the industry of forming material, such as steel, in a press or stamping machine in order to achieve a desired shape for a part. Dies can vary in size and weight. For example, dies may be 84 inches in length and weigh approximately 86,000 pounds. Dies may even be 180 inches in length and weigh 200,000 pounds. Due to the large size and weight of these dies, storage becomes problematic. Cranes are often utilized to hoist the dies in the air in order to properly move and/or position them from a storage position to the machines. It is common for wood 4×4s and 6×6s to be positioned between stored dies, so that it is easier to select and move a die from its stored position. It is very cumbersome using such large pieces of wood since they are awkward to move and position between dies. Also, wood adds to overhead costs, especially if it needs to be replaced often.

Die buffers have been introduced to the forming industry and may take the form of a polymeric load-bearing base, a neck portion, and a circular foot. A die buffer known in the art is illustrated in FIGS. 1 and 2. The circular foot is attached to the neck, and the neck attached to the load-bearing base. Generally, these three components are attached together through each respective central axis.

Although current designs have helped in eliminating the need for wood to separate adjacent dies, many disadvantages are apparent from known die buffers. First, the foot portion of the die buffer is generally circular. The circular foot prevents the die from fully contacting the topside surface area of the load-bearing base. Thus, the die buffer is not being used to its full capacity. Another disadvantage of the present design is that the neck and foot attach to the load-bearing base about the central axis. Again this minimizes the amount of contact between the surface area of the topside of the load-bearing base and the die at issue. While the design shown in FIGS. 1 and 2 is better than wood planks, it is not being used to its fullest potential.

Therefore, there is a need in art to redesign a die buffer so that more than 50% of the surface area of the topside of the load-bearing base contacts and supports the die located thereabove.

SUMMARY OF THE INVENTION

The present invention is an ergonomic die buffer, which comprises a load-bearing base having a central axis extending longitudinally through a midpoint of the load-bearing base. A neck portion is operatively connected to the load-bearing base, and a foot is connected to the neck portion.

Accordingly, it is an object of the present invention to provide a die buffer where the neck portion is operatively connected to the load-bearing base in a spaced relationship with the central axis.

It is yet another objective of the present invention to provide a die buffer where the load-bearing base has a topside with a surface area A1, such that more than 50% of the topside surface area contacts the associated die.

Another object of the present invention is to provide a die buffer wherein the loads bearing means and the neck portion have a hole defined therein for receiving a fastener.

It is yet another object of the present invention wherein the hole defined in the load-bearing base has different diameters.

Further, another object of the present invention is to provide a die buffer where the foot has a hole defined therein for receiving the fastening means.

Further yet, another object of the present invention is to provide a die buffer that is spring loaded for easy attachment to and detachment from a die receiving slot.

Another object of the present invention is to provide a die buffer that is operated through magnets to attach the die buffer to an associated die.

Still yet, another object of the present invention is to provide a die buffer further comprising attaching means for operatively connecting the die buffer to an associated die.

Still yet, another object of the present invention is to provide a die buffer wherein the load-bearing base is substantially cylindrical.

Another object of the present invention is to provide a die buffer wherein the load-bearing base is made of a polymeric material.

Further, another object of the present invention is provide a die buffer wherein the foot comprises a straight edge and an arcuately shaped edge, wherein the straight edge is positioned flush against a die.

Yet, another object of the present invention is to provide a die buffer that is easy to use and economical to manufacture.

Still other benefits and advantages of the invention will become apparent to those skilled in the art to which it pertains upon a reading and understanding of the following detailed specification.

BRIEF DESCRIPTION OF THE DRAWINGS

The invention may take physical form in certain parts and arrangement of parts, a preferred embodiment of which will be described in detail in this specification and illustrated in the accompanying drawings which form a part hereof and herein.

DESCRIPTION OF THE PREFERRED EMBODIMENT

Figure 1:
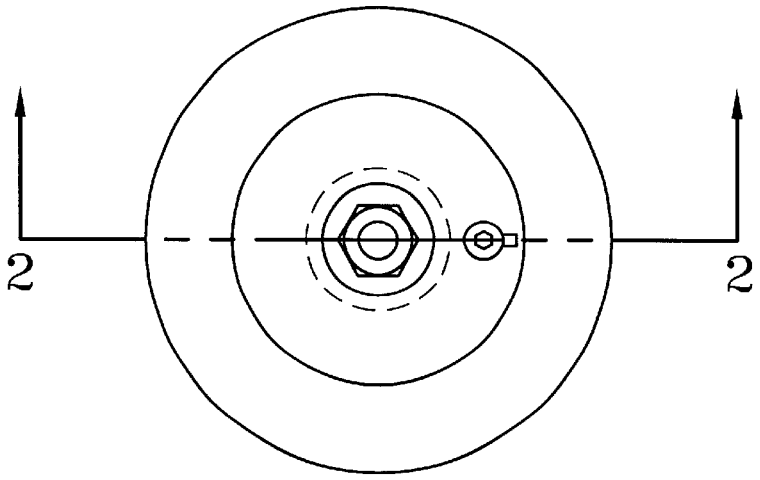
FIG-1 PRIOR ART
FIG. 1 is a top view of a die buffer known in the art.
Figure 2:
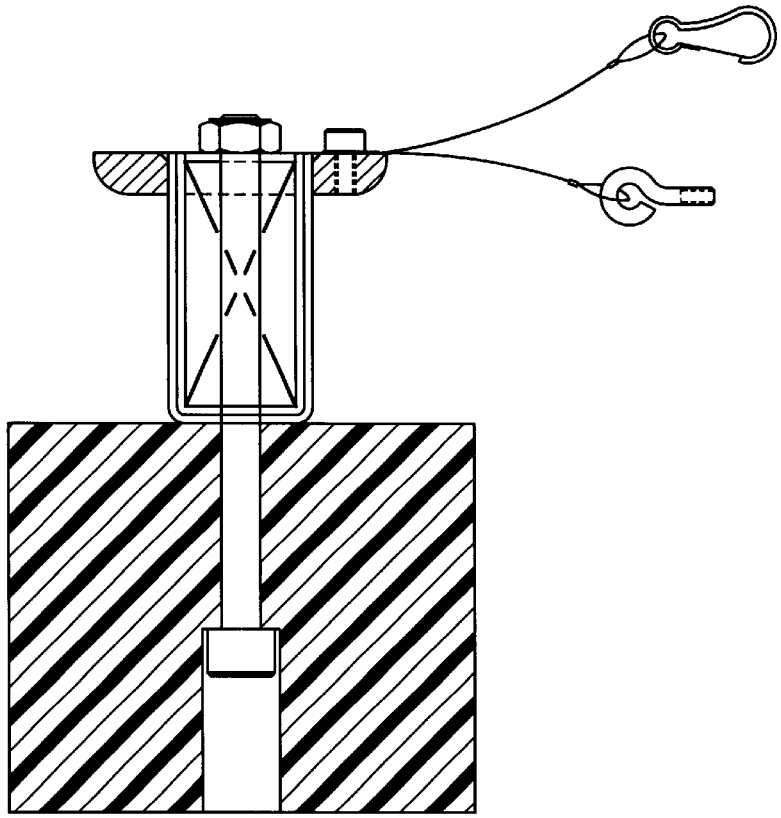
FIG-2 PRIOR ART
FIG. 2 is a cross-sectional view the die buffer illustrated in FIG. 1 taken along line 2—2.

Referring now to the drawings wherein the showings are for purposes of illustrating a preferred embodiment of the invention only and not for purposes of limiting the same, FIGS. 3–10 illustrate the present invention. A die buffer 10 is adapted to be used in association with a pair of dies to enable each die to be placed upon one another with the die buffer therebetween. Alternatively, one die may be placed upon some other object with the die buffer 10 positioned therebetween.

Figure 3:
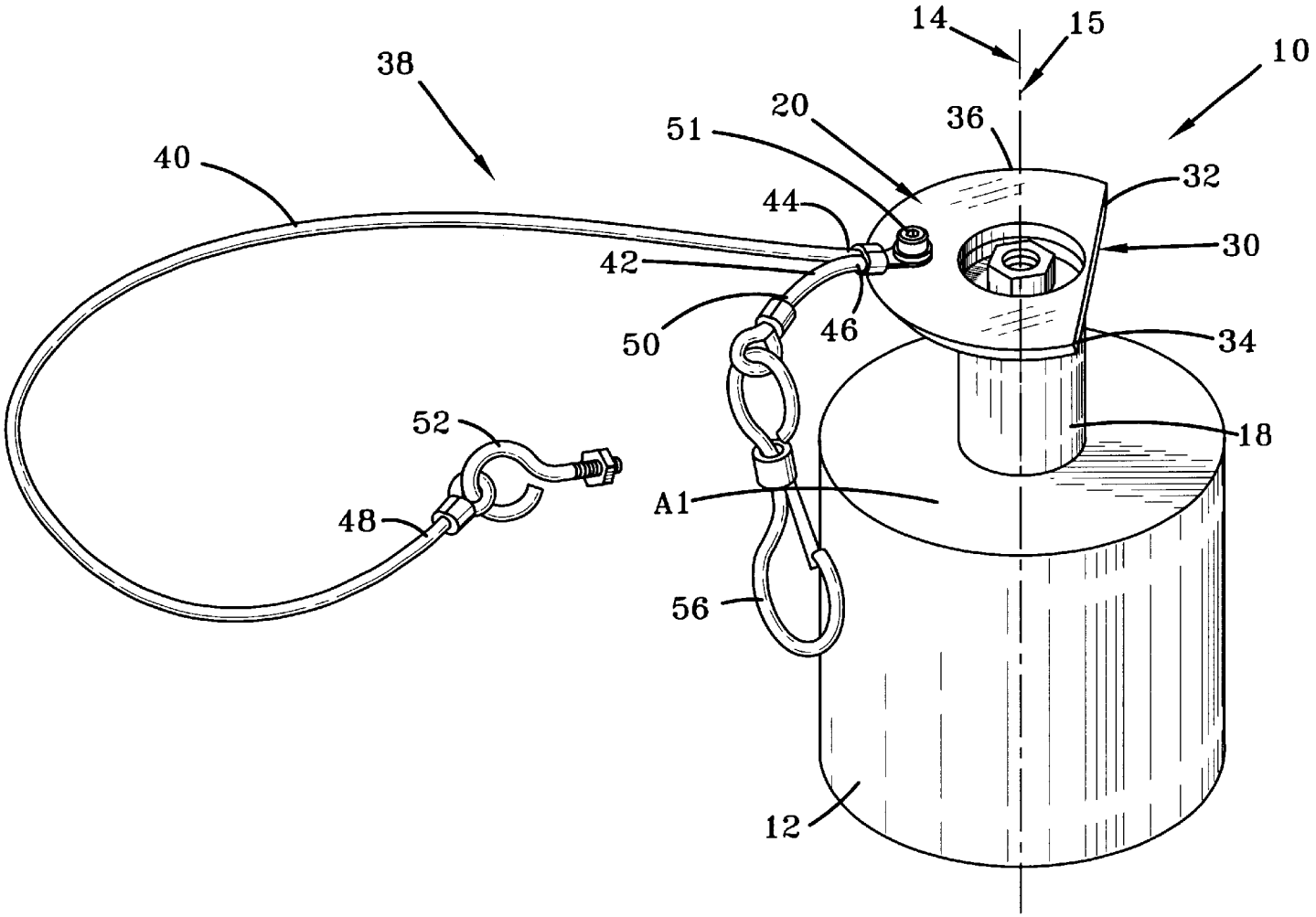
FIG. 3 is a perspective view of the present invention.
Figure 4:
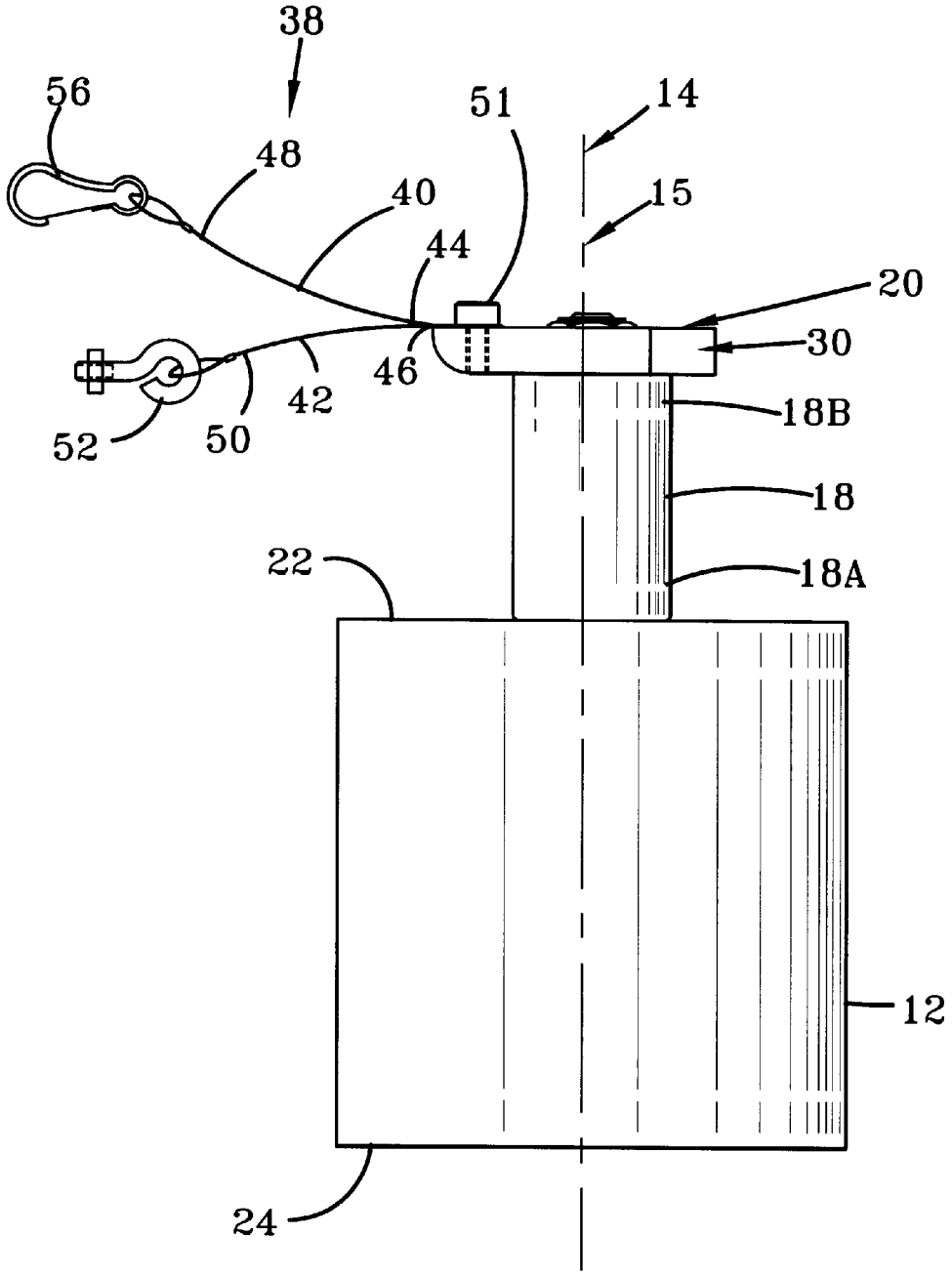
FIG. 4 is an elevational view of the present invention.
Figure 5:
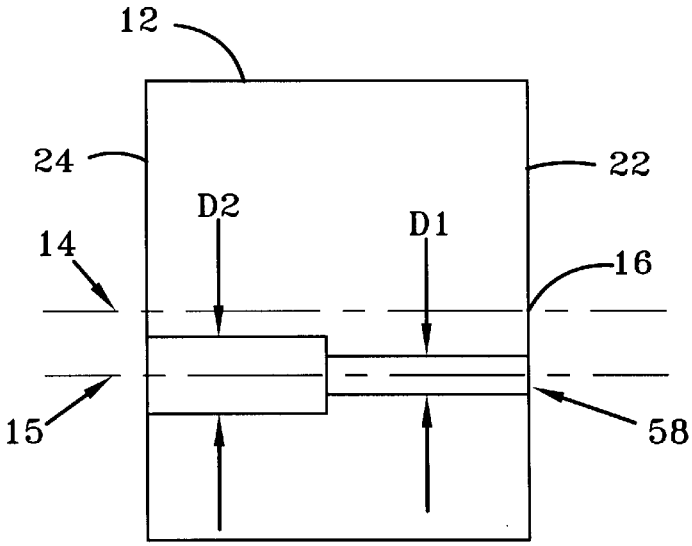
FIG. 5 is a cross-sectional view of the load-bearing base of the present invention showing off-centered hole defined therein.
Figure 6:
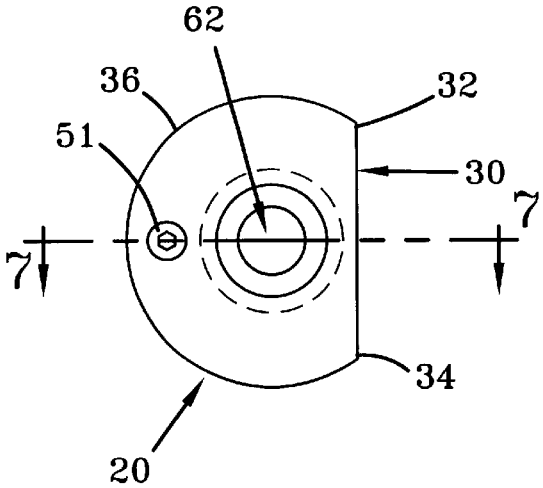
FIG. 6 is a top view of the foot and neck portion of the die buffer.
Figure 7:
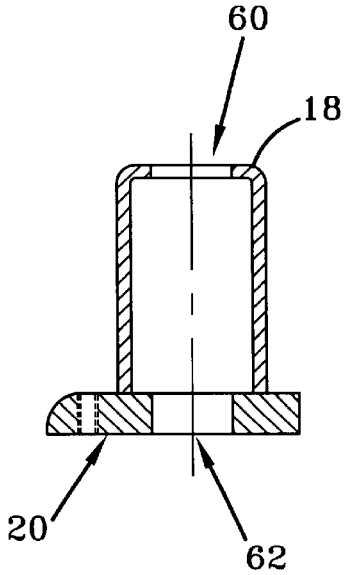
FIG. 7 is a cross-sectional view of the neck and foot portion taken along line 7—7 of FIG. 6.
Figure 8:
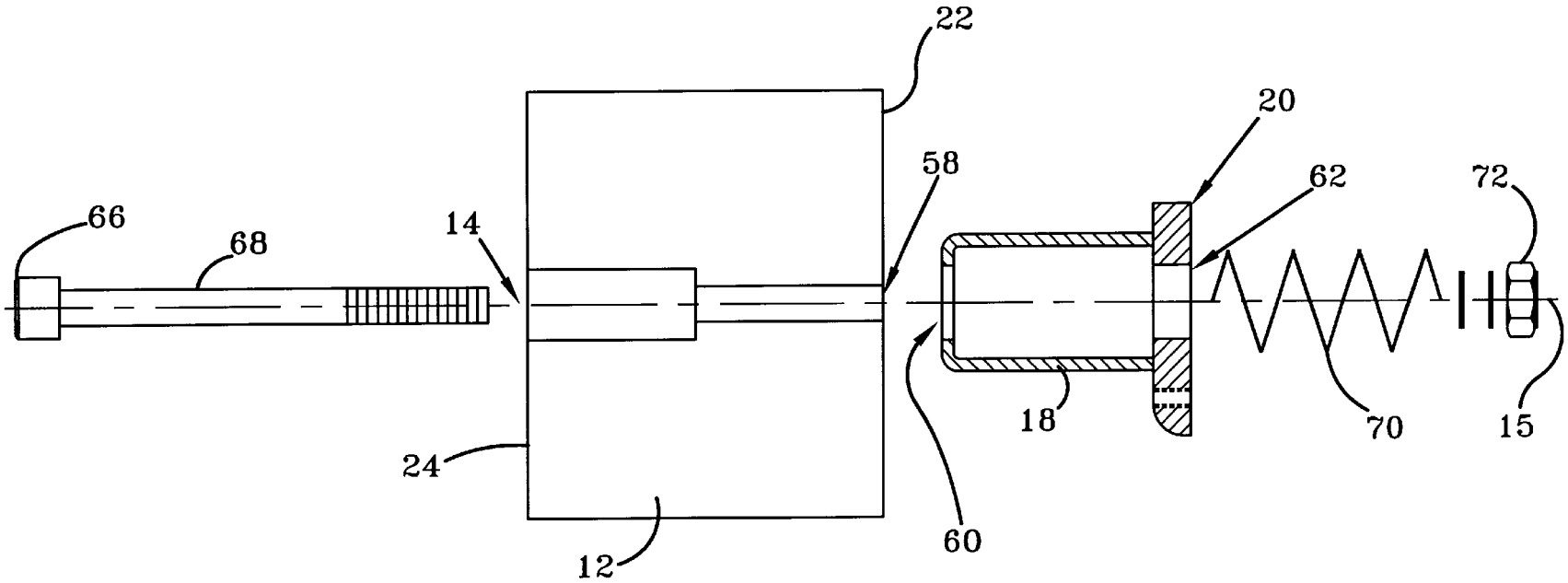
FIG. 8 is an exploded view of the present invention showing a spring loaded die buffer.

Turning to FIGS. 3 and 4, the ergonomic die buffer 10 comprises a load-bearing base 12 having a central axis 14 extending longitudinally through a midpoint 16 of the load-bearing base 12. The load-bearing base 12 further comprises a longitudinal axis 15. As shown in FIG. 8, the longitudinal axis 15 may be coaxial with the central axis 14. However, the longitudinal axis 15 may be displaced from the central axis 14, as shown in FIG. 5. FIG. 4 shows a neck portion 18 comprising first and second ends 18A, 18B. The first end 18A is operatively connected to the load-bearing base 12, and a foot 20 is connected to the second end 18B of the neck portion 18, as shown in FIGS. 3, 4, 6 and 7–9. The neck portion 18 also has a central axis, which is coaxial with the longitudinal axis 15 of the load-bearing base 12. The neck portion 18 may be formed separately from the foot 20 or the two may be integrally formed together. For example, the neck portion 18 and the foot 20 may be welded together. Also, the neck portion 18 may be welded to the load-bearing base 12.

Figure 9:
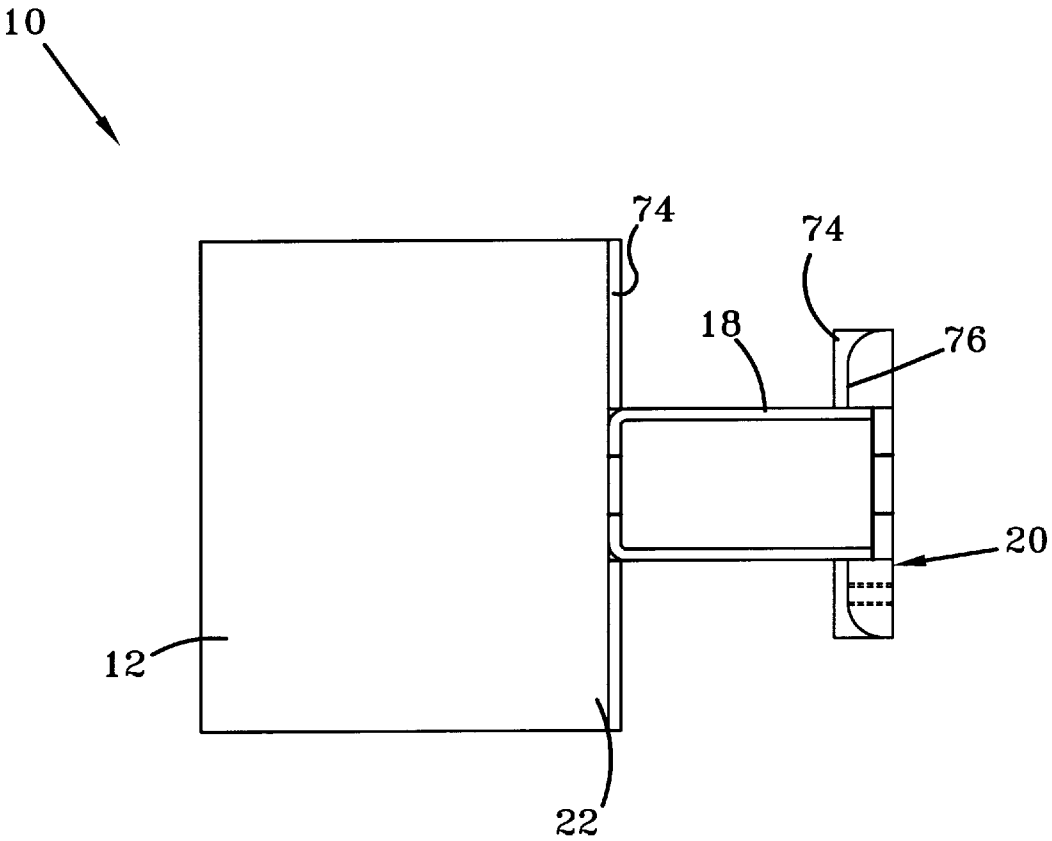
FIG. 9 illustrates the present invention utilizing a magnet to secure the die buffer to the die; and, FIG. 10 shows the present invention positioned in a receiving slot of an associated die.

The load-bearing base 12 has a topside 22 and an underside 24. The topside 22 has a surface area A1. As shown in FIGS. 8 and 9, the central axis of the neck portion 18 is coaxial with the central axis 14 of the load-bearing base 12. However, it is preferred that the longitudinal axis 15 of the load-bearing base be coaxial with the central axis of the neck portion 18, where the longitudinal axis 15 is displaced from the central axis 14 of the load-bearing base 12, as shown in FIG. 5. This provides for the neck portion 18 and the foot 20 to be slightly off-center relative to the central axis 14 of the load-bearing base 12. With this configuration, more than 50% of the surface area of the topside 22 of the load-bearing base 12 contacts and supports the associated die positioned thereabove.

As shown in FIGS. 3–10, the neck portion 18 is generally cylindrical, but this is not required. It is preferred that the neck portion 18 have a smaller diameter than the load-bearing base 12 so that the neck portion 18 may be received in a slot 26 of an associated die 28, best seen in FIG. 10. This also provides for greater surface area contact between the load-bearing base 12 and the die 28.

The foot 20 functions as a stop or block against the die 28. As shown in FIGS. 3, 4, 6 and 7, the foot 20 has a substantially flat surface 30 with first and second ends 32, 34. The foot 20 also comprises an arcuately shaped edge 36 that extends from the first end 32 of the flat surface 30 to the second end 34 of the flat surface 30. Since the foot 20 is not completely circular, there is greater contact between the topside 22 of the load-bearing base 12 and the die 28 it supports, when the die 28 is being stored. The foot 20 may take any geometry that is not completely circular in nature, such as square or triangular, but the geometry is not limited thereto.

Figure 10:
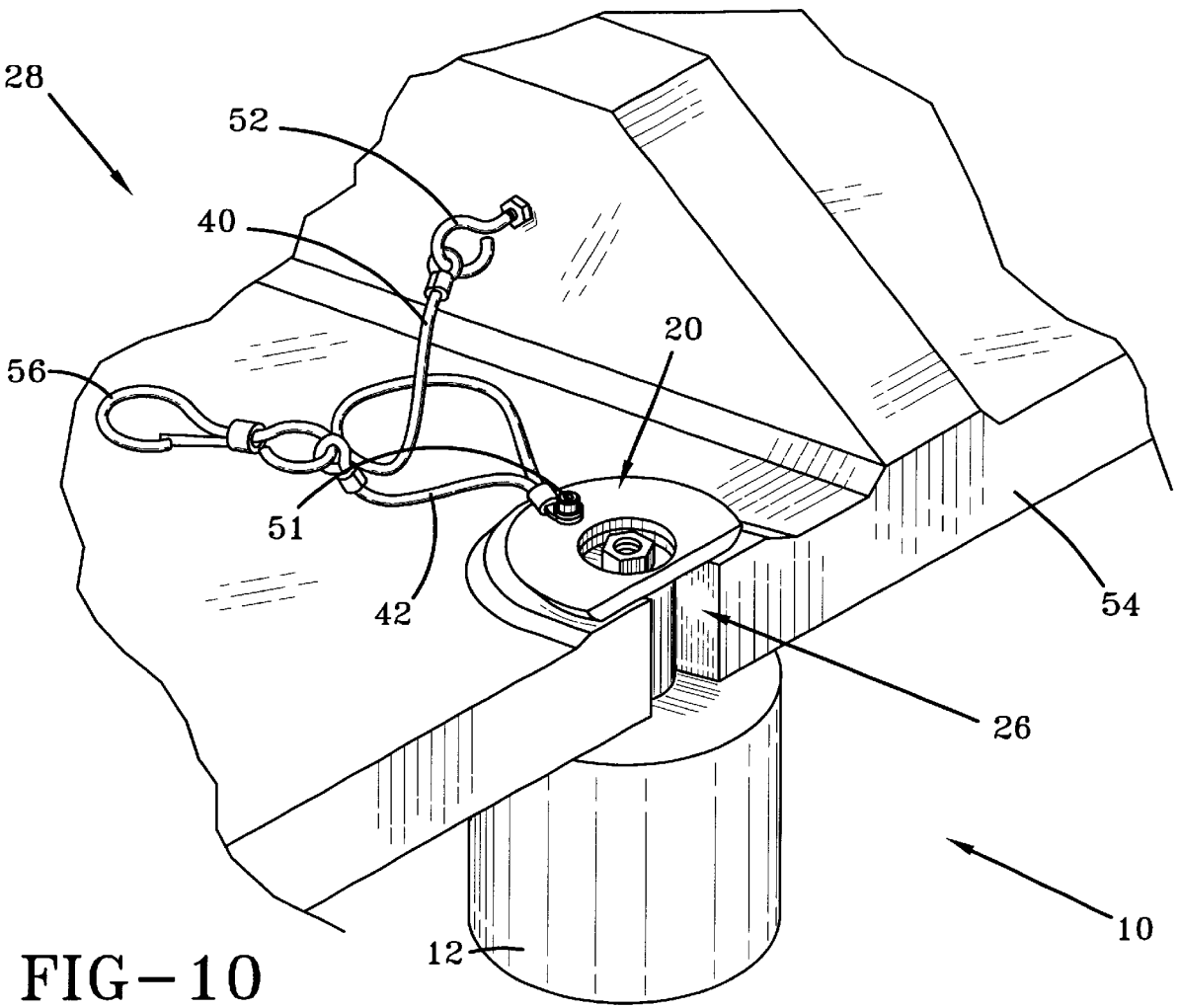

As shown in FIGS. 3, 4 and 10, the die buffer 10 also comprises an attaching means 38 for securely fastening the die buffer 10 to the associated die 28, regardless of whether the die 28 is being stored or used in a machine (not shown). The attaching means 38 may comprise two wire cables 40, 42 connected to the foot 20. Each wire cable 40, 42 has first and second ends 44, 46, 48, 50. The first ends 44, 46 of each wire cable 40, 42 are attached to the foot 20. As shown in FIGS. 3 and 4, the wire cables 40, 42 are attached opposite the straight edge 30 of the foot 20. However, the wire cables 40, 42 may be placed anywhere along the foot 20, or the die buffer 10 itself, provided it does not interfere with the die buffer 10 supporting the die 28. As shown in FIGS. 3, 4, and 6–9, the wire cables are secured to a pin 51 that passes through the foot 20. It is also contemplated to be within the scope of the invention for the attaching means 38 to comprise only one wire cable that is crimped and then attached to the foot 20. Further, the cable does not necessarily need to be made of wire. Any suitable material chosen with sound engineering judgment may be utilized.

Returning to FIGS. 3, 4 and 10, the second end 48 of the first wire cable 40 has an eye bolt 52 that may be threadably secured to a lower die shoe 54. The second end 50 of the second wire cable 42 has a spring hook 56 attached thereto. Generally, the eye bolt 52 is not disconnected from the die 28, thus, regardless if the die 28 is being used in a machine or is being stored, the die buffer 10 will be connected to the die 28. When the die 28 needs to be used with a machine, the die buffer 10 is pulled out of the receiving slot 26 of the lower die shoe 54. The spring hook 56 then is depressed such that it can be attached to the eye bolt 52. When the spring hook 56 is attached to the eye bolt 52, the die buffer 10 is suspended from the eye bolt 52, and it may travel with the die 28 while it is being used in a machine. When the die 28 is being used, the die buffer 10 is out of the way for easy storage and decreases the chance of the die buffer 10 being lost. When a die buffer 10 is being used to store a die 28, it may be preferred that a plurality of die buffers be positioned about the perimeter of the die 28, such as in the four corners of a die, to provide proper support for the same.

The die buffer 10 may operatively connect to a stored die 28 in a number of ways, and any method may be chosen with sound engineering judgment. No matter which embodiment is utilized, the receiving slot 26 of the die 28, which is best seen in FIG. 10, generally receives the neck portion 18 of the die buffer 10. The die buffer 10 is then further secured to the die 28, as will now be described. As shown in FIGS. 3, 4 and 6–8, the die buffer 10 may be spring loaded in order to properly fasten or secure the die buffer 10 on the die 28 for proper storage and support. In this embodiment, holes 58, 60, 62 are defined in the load-bearing base 12, the neck portion 18, and the foot 20. These holes 58, 60, 62 are aligned and a fastener is passed therethrough. As shown in FIG. 8, the head 66 of a bolt 68 is supported on the underside 24 of the load-bearing base 12. However, it is preferred, as shown in FIG. 5, that the hole defined 58 in the load-bearing base 12 has at least two different diameters D1, D2 so that the bolt 68 may be seated within the load-bearing base 12. Once the bolt 68 passes through the neck portion 18 and the foot 20, a spring 70 is inserted over the bolt 68 and is housed within the neck portion 18. A nut 72 is securely attached to the bolt 68. This provides for a spring-loaded connection so that the foot 20 and the load-bearing base 12 exert compressive forces against the die 28 it is supporting via the spring 70.

An alternate embodiment for securing the die buffer 10 to the associated die 28 is shown in FIG. 9. In this embodiment, at least one magnet 74 is activated in order to provide a secure connection between the die buffer 10 and the associated die 28. FIG. 9 illustrates the magnet 74 attached to the bottom side 76 of the foot 20. Alternatively, the magnet 74 may be attached to the topside 22 of the load-bearing base 12. In the preferred embodiment, the magnet 74 is attached to both the bottom side 76 of the foot 20 and the topside 22 of the load-bearing base 12. Upon activation of the magnets 76, the die buffer 10 is magnetically connected to the associated die 28.

As shown in the FIGS. 3–10, the load-bearing base 12 is generally cylindrical in shape; however, this is not required. Any shape may be chosen with sound engineering judgment. Also the material used to construct the load-bearing base 12 is generally a polymeric material. A suitable polymeric material may include, without limitation, neoprene, which is manufactured by DuPont Dow Elastomers. Of course any material, which can withstand the compressive loads exerted by the dies may be used, such as wood, metal, steel or other polymeric material.

Some examples of the compressive forces the die buffer 10 may encounter will now be described. For an 84-inch die, four five-inch diameter die buffers may be used. It is contemplated that the 84-inch die would weigh approximately 86,000 pounds, which would result in 1,955 pounds per square inch (psi) of pressure being exerted by the die on each load-bearing base and 21,500 psi being exerted from each load-bearing base to the floor. For a 120-inch die, six die buffer blocks having a five-inch diameter may be used. The total weight of the die may be up to 130,000 pounds. In this case, each load-bearing base of each die buffer will have 1,970 pounds per square inch exerted thereon from the die. Further, 21,666 psi will be exerted from the load-bearing base to the floor. Yet another example shows a 180-inch die, which would use eight blocks of having a five-inch diameter. The total weight of the 180-inch die is expected to be approximately 200,000 pounds. The die would exert approximately 2,273 psi on the load-bearing base of the die buffer. Therefore, approximately 25,000 psi will be exerted from each load-bearing base to the floor. In all these examples it may be desirable to double stack the load-bearing base.

As shown in FIGS. 3–10, it is preferable to have the maximum amount of contact between the topside 22 of the load-bearing base 12 and the die 28 it is supporting. A die buffer 10 having a five-inch diameter load-bearing base 12 has a topside surface area A1 of approximately 19.6 square inches. With this embodiment, at least eleven square inches of the topside contacts the die 28, which results in approximately 56% contact between the topside 22 surface of the load-bearing base 12 and the die 28 it supports. It is preferable for this percentage to be even higher, preferably as high as 70%. As previously stated, the die buffer 10 is able to provide greater support when the die 28 contacts a greater percentage of the topside surface area.

The invention has been described with reference to a preferred embodiment. Obviously, modifications and alterations will occur to others upon a reading and understanding of this specification. It is intended to include all such modifications and alternations in so far as they come within the scope of the appended claims or the equivalence thereof.

Having thus described the invention, it is now claimed:

1. A die buffer adapted to be used in association with an associated die to enable the die to be placed upon another object with said die buffer therebetween, the die having a flat edge, the flat edge having a slot for receiving said die buffer, said die buffer comprising:

a base, said base having a longitudinal axis and a central axis, said central axis extending longitudinally through a midpoint of said base, said base having a hole extending longitudinally through said base and through said longitudinal axis;

a neck having first and second ends, said first end connected to said base, said neck having a central axis which is coaxial with said longitudinal axis of said base; and, a foot connected to said second end of said neck, said foot having at least one substantially flat surface, said flat surface adapted to be positioned approximately 180 degrees opposite to the flat edge of the associated die.

2. The die buffer of claim 1, wherein said longitudinal axis is displaced from said central axis of said load-bearing base.

3. The die buffer of claim 1, wherein said base has a topside with a surface area, such that more than 50% of said surface area contacts the associated die.

4. The die buffer of claim 1, wherein said foot comprises an arcuately shaped surface extending from a first end of said flat surface to a second end of said flat surface.

5. The die buffer of claim 1, further comprising a fastener, said fastener being received by said hole.

6. The die buffer of claim 5, wherein said hole has two different diameters.

7. The die buffer of claim 5, further comprising:

a spring, said spring being housed in said neck and connected to said foot, wherein said die buffer is spring loaded to secure said die buffer to the associated die.

8. The die buffer of claim 1, further comprising a magnet operatively connected to a bottom side of said foot.

9. The die buffer of claim 1, further comprising a magnet operatively connected to a topside of said base.

10. The die buffer of claim 1, further comprising attaching means for operatively connecting said die buffer to the associated die.

11. The die buffer of claim 10, wherein said attaching means comprises:

at least one wire cable connected to said foot, said wire cable having first and second ends, an eye bolt connected to said first end of said wire cable, said eye bolt being attached to the associated die; and, a spring hook attached to said second end of said wire cable, such that said die buffer is suspended from said eye bolt when said spring hook is attached to said eye bolt.

12. The die buffer of claim 1, wherein said base is substantially cylindrical.

13. A die buffer adapted to be used in association with a die to enable the die to be placed upon another object with said die buffer therebetween, the die having a flat edge, the flat edge having a slot for receiving said die buffer, said die buffer comprising:

a base, said base having a longitudinal axis and a central axis, said central axis extending longitudinally through a midpoint of said base, said base having a hole extending longitudinally through said base and through said longitudinal axis, said longitudinal axis being displaced from said central axis of said base;

a neck having first and second ends, said first end connected to said base, said neck having a central axis which is coaxial with said longitudinal axis of said base; and, a foot connected to said second end of said neck.

14. The die buffer of claim 13, wherein said foot has at least one substantially flat surface, said flat surface being positioned approximately 180 degrees opposite the flat edge of the associated die.

15. The die buffer of claim 13, wherein said base has a topside with a surface area, such that more than 50% of said surface area contacts the associated die positioned thereabove.

16. The die buffer of claim 13, wherein said foot comprises an arcuately shaped surface extending from a first end of said flat surface to a second end of said flat surface.

17. The die buffer of claim 13, wherein said hole is two different sizes.

18. The die buffer of claim 13, wherein said neck is cylindrical, said die buffer further comprising:

a spring, said spring being housed in said cylindrical neck and being connected to said foot, wherein said die buffer is spring loaded to secure said die buffer to the associated die.

19. A die buffer adapted to be used in association with a die to enable the die to be placed upon another object with said die buffer therebetween, the die having a flat edge, the flat edge having a slot for receiving said die buffer, said die buffer comprising:

a base with a topside surface area, said base having a longitudinal axis and a central axis, said central axis extending longitudinally through a midpoint of said base, said base having a hole extending longitudinally through said base and through said longitudinal axis, wherein said longitudinal axis is displaced from said central axis of said base;

a neck having a first end and a second end, said first end connected to said base, said neck having a central axis which is coaxial with said longitudinal axis of said base; and, a foot connected to said second end of said neck, wherein more than 50% of said topside surface area is contacted by the associated die positioned thereabove.

20. A die buffer adapted to be used in association with a die to enable the die to be placed upon another object with said die buffer therebetween, the die having a flat edge, the flat edge having a slot for receiving said die buffer, said die buffer comprising:

a base with a topside surface area, said base having a longitudinal axis and a central axis, said central axis extending longitudinally through a midpoint of said base, said base having a hole extending longitudinally through said base and through said longitudinal axis;

a neck having a first end and a second end, said first end connected to said base, said neck having a central axis which is coaxial with said longitudinal axis of said base; and, a foot connected to said second end of said neck, wherein more than 50% of said topside surface area is contacted by the associated die positioned thereabove, wherein said foot comprises at least one flat surface, said flat surface facing 180 degrees opposite the flat edge of the associated die.

21. A die buffer adapted to be used in association with a die to enable the die to be placed upon another object with said die buffer therebetween, the die having a flat edge, the flat edge having a slot for receiving said die buffer, said die buffer comprising:

a base with a topside surface area, said base having a longitudinal axis and a central axis, said central axis extending longitudinally through a midpoint of said base;

a neck having a first and second end, said first end connected to said base, said neck having a central axis which is coaxial with said longitudinal axis of said base, wherein said neck is attached to said base through said longitudinal axis, said longitudinal axis being displaced from said central axis of said base;

a foot connected to said second end of said neck; and, at least one magnet attached to said die buffer for securing said buffer to the associated die.

22. The die buffer of claim 21, wherein said magnet is attached to said topside of said base.

23. The die buffer of claim 21, wherein said magnet is attached to a bottom side of said foot.

24. The die buffer of claim 21, wherein more than 50% of said topside surface is contacted by the associated die positioned thereabove.

25. A die buffer adapted to be used in association with a die to enable the die to be placed upon another object with said die buffer therebetween, the die having a flat edge, the flat edge having a slot for receiving said die buffer, said die buffer comprising:

a base with a topside surface area, said base having a longitudinal axis and a central axis, said central axis extending longitudinally through a midpoint of said base;

a neck having a first and second end, said first end connected to said base, said neck having a central axis which is coaxial with said longitudinal axis of said base;

a foot connected to said second end of said neck, wherein said foot comprises at least one flat surface oppositely disposed from the flat edge of the associated die; and, at least one magnet attached to said die buffer for securing said buffer to the associated die.

26. A die system, comprising:

an upper die and a lower die, each die having a lower die shoe, each of said dies having a flat edge with a slot extending from said flat edge into said die; and, a die buffer adapted to be used with said upper and lower dies to enable each die to be placed upon one another with said die buffer therebetween, said die buffer being received within said slot of said upper die, said die buffer comprising:

a substantially cylindrical base having a longitudinal axis and a central axis, said central axis extending longitudinally through a midpoint of said base, said longitudinal axis being spaced from said central axis of said base, said base having a topside with a surface area, such that more than 50% of said surface area contacts said upper die, said base having a hole extending longitudinally through said base for receiving a fastener, said hole having two different diameters;

a cylindrical neck having a central axis and first and second ends, said central axis being coaxial with said longitudinal axis of said base, said first end being operatively connected to said base, said cylindrical neck having a hole defined therein for receiving said fastener;

a foot connected to said second end of said neck portion, said foot having a substantially flat surface with first and second ends, said flat surface being positioned approximately 180 degrees opposite to said flat edge of said lower die, said foot further comprising an arcuately shaped edge extending from one end of said flat surface to said second end of said flat surface, said foot further comprising a hole defined therein for receiving said fastener;

a spring housed in said cylindrical neck and attached to said foot, wherein said die buffer is spring loaded; and, attaching means for operatively connecting said die buffer to said die, said attaching means comprising at least one wire cable with first and second ends, an eye bolt attached to said first end of said wire cable, and a spring hook attached to said second end of said wire cable, such that when said spring hook is attached to said eye bolt, said die buffer is suspended from said eye bolt.

* * * * *